United States Patent [19]

Place et al.

[11] Patent Number: 4,885,925

[45] Date of Patent: Dec. 12, 1989

[54] STRAP FOR AUTOMOTIVE BODY WORKING

[76] Inventors: Steven C. Place, P.O. Box 164, Wixom, Mich. 48096; Arnold S. Hoffman, 20409 Lexington, Redford, Mich. 48240

[21] Appl. No.: 281,649

[22] Filed: Dec. 9, 1988

[51] Int. Cl.[4] ..... B21D 1/12

[52] U.S. Cl. ..... 72/292; 72/705; 72/379

[58] Field of Search ..... 72/396, 292, 705, 392, 72/379; 254/133 R

[56] References Cited

U.S. PATENT DOCUMENTS

| | | | |
|---|---|---|---|
| 2,032,150 | 2/1936 | Richardson | 221/37 |
| 2,600,068 | 6/1952 | Meyers | 294/1.1 |
| 2,835,154 | 5/1958 | Geller | 72/705 |
| 2,858,872 | 11/1958 | Hougen | 72/392 |
| 2,948,327 | 8/1960 | Horner | 72/292 |
| 3,477,269 | 11/1969 | Dinerman | 72/705 |
| 3,729,974 | 5/1973 | Tidwell | 72/705 |

*Primary Examiner*—Robert L. Spruill

*Attorney, Agent, or Firm*—Gifford, Groh, Sheridan, Sprinkle and Dolgorukov

[57] ABSTRACT

A device for use in repairing automotive bodies which has an elongated flexible strap constructed of a tough material, such as reinforced neoprene rubber. A ring is attached to one end of the strap while at least one and preferably several elongated strips of double-sided adhesive tape is secured to one side of the strap. The other side of the adhesive tape is adhesively secured to the automotive body so that a longitudinal force imposed on the strap through the ring is transmitted through the adhesive tape into the automotive body.

6 Claims, 1 Drawing Sheet

STRAP FOR AUTOMOTIVE BODY WORKING

BACKGROUND OF THE INVENTION

1. Field of the Invention

The present invention relates generally to tools and, more particularly, to a tool particularly suited for use in automotive body working.

2. Description of the Prior Art

Automotive body working shops repair automotive vehicles that have suffered damage in some fashion. for example, automotive vehicles involved in collisions are conventionally repaired by the automotive body working shop in order to restore the automotive body to its original condition.

In many cases, particularly after the vehicle has been damaged in a collision, a body panel is bent from its normal condition. In these cases, it is necessary to bend the body panel back to its original position.

The previously known practices for bending body panels has been to utilize an elongated strap having a hook at one end and a ring at its other end. The hook is positioned so that it engages a rigid frame member or the like on the vehicle while a come-along is attached to the ring at the other end of the strap. When the come-along is activated to pull the ring, the strap, which abuts against the body panel, bends the body panel accordingly.

While these previously known straps have proven adequate for many different types of vehicles, many of the newer vehicles do not include a rigid frame member in which to attach the strap hook. Furthermore, it is not possible to attach the hook directly to the panel member itself since the panel member would be damaged upon activation of the come-along.

SUMMARY OF THE PRESENT INVENTION

The present invention provides a tool for automotive body working which overcomes all of the above-mentioned disadvantages of the previously known devices.

In brief, the device of the present invention comprises an elongated flexible strap having an elongated and flat side. Preferably the strap is constructed of a tough material, such as neoprene rubber, and is nylon reinforced.

A ring is attached to one end of the strap. This ring can be of any conventional shape, such as triangular or a D-shaped ring. Furthermore, although any conventional means can be used to secure the ring to the end of the strap, preferably a fabric section is secured to the end of the strap so that the fabric section forms a loop in which a portion of the ring is contained.

The device of the present invention further comprises at least one and preferably several elongated flat strips wherein each strip has an adhesive layer on both of its sides. Said strips are also known as "double sided tape". The strips are adhesively secured to the elongated flat side of the strap so that the strips extend longitudinally along the longitudinal axis of the strap. The flat side of the strap is then pressed against the automotive body panel so that the other side of the adhesive strips contact and are adhesively secured to the body panel. In doing so, the strap is adhesively attached to the body panel.

In operation, a come-along is then attached to the ring in order to bend the body panel in the conventional fashion. After the body panel has been bent, the strap with its adhesive strips is simply peeled away from the body panel without damaging the body panel. Thereafter, the adhesive strips can be removed from the strap and replaced with new strips whenever required.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
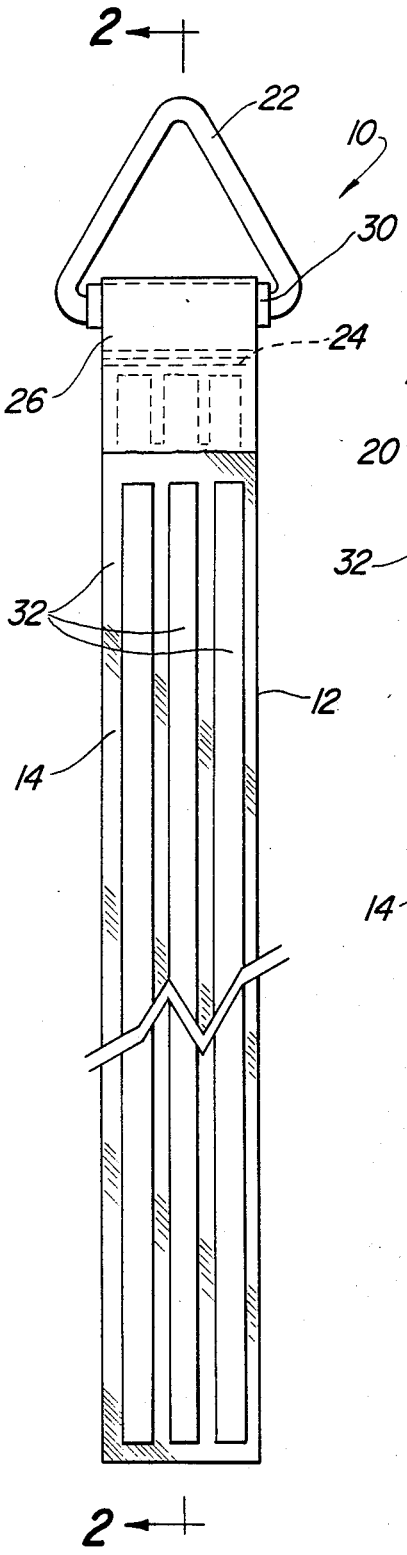
FIG. 1 is a plan view illustrating a preferred embodiment of the present invention.
Figure 2:
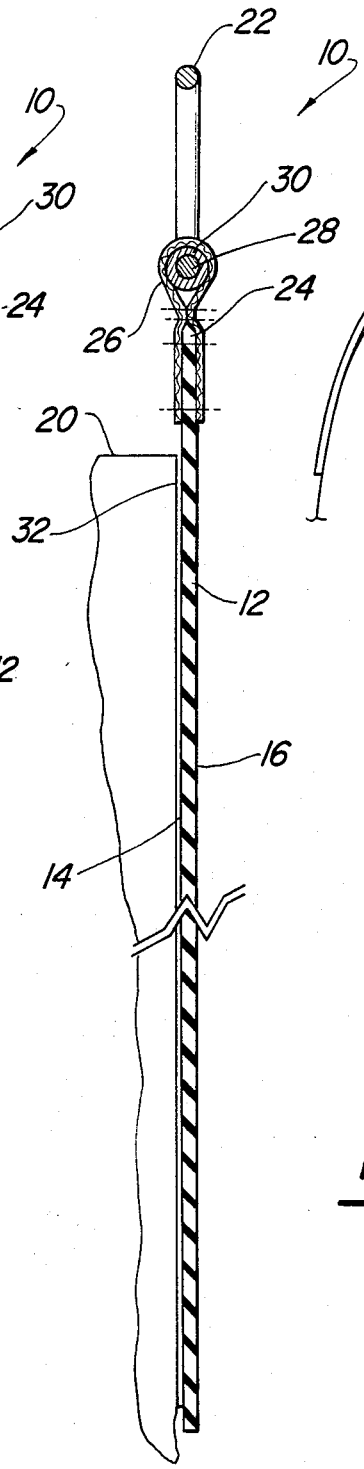
FIG. 2 is a side view illustrating a preferred embodiment of the present invention.

With reference first to FIGS. 1 and 2, a preferred embodiment of the body working tool 10 of the present invention is thereshown and comprises an elongated flexible strap 12. The strap 12 includes two flat sides 14 and 16.

Although the flexible strap 12 may be of any conventional construction, in the preferred embodiment of the invention the strap is constructed from neoprene rubber which is reinforced with nylon fibers. Preferably, the strap 12 is triple reinforced with nylon fibers so that the strap 12, while flexible, is essentially non-elastic. Furthermore, due to the reinforcement provided by the nylon fibers 18, the strap 12 has a tensil strength which greatly exceeds the strength necessary to bend an automotive body panel 20.

Still referring to FIGS. 1 and 2, a ring 22 is attached to one end 24 of the strap 12. The ring 22 is constructed of any strong material, such as steel, and is preferably triangular in shape although other shapes, such as a D-shaped ring, can also be used.

Although any conventional means can be used to secure the ring 22 to the strap 12, preferably a fabric section 26 is secured to the end 24 of the strap 12 so that the fabric section 26 forms a loop. A straight segment of the ring 22 is positioned within the fabric loop thereby securing the strap 12 and loop 22 together. Additionally, a tube 30 is preferably rotably coaxially positioned around the straight section 28 of the ring 22 to protect the fabric section 26 from wear and tear caused by the ring 22.

Still referring to FIGS. 1 and 2, the tool 10 of the present invention further comprises at least one and preferably several elongated strips 32. Each strip 32 includes an adhesive layer on each of its sides. One side of each strip 32 is then adhesively positioned against the side 14 of the strap 12 so that the strips 32 are spaced apart and parallel to each other and also so that the longitudinal axis of the strips 32 extend in the same direction as the longitudinal axis of the strap 12.

Figure 3:
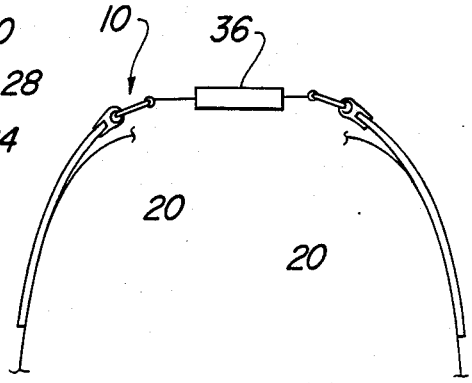
FIG. 3 is a perspective view illustrating the use of the preferred embodiment of the present invention.

As best shown in FIGS. 2 and 3, the side 14 of the strap 12 is then pressed against the body panel 20 so that the other sides of the strips 32 contact and adhesively secure the strap 12 to the body panel 20. A come-along 36 (FIG. 3) is then attached to the ring 22 so that, upon activation of the come-along 36, the come-along 36 transmits a longitudinal force to the strap 12 which, in turn, transmits this longitudinal force to the body panel 20 through the adhesive strips 32. In practice, it has been found that the adhesive strips 32 are not only capable of transmitting sufficient force to the body panel 20 in order to bend to its desired position, but also that the adhesive strips 32 do so without marring or otherwise damaging the body panel 20.

Figure 4:
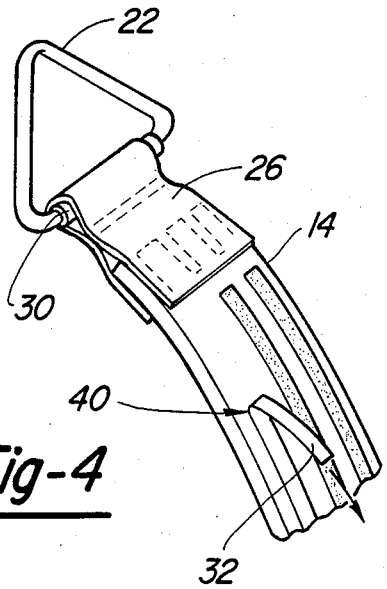
FIG. 4 is a fragmentary view illustrating a portion of the preferred embodiment of the present invention.

After the body panel 20 has been bent to its desired position, the strap 12 together with the strips 32 is simply peeled away from the body panel 20. Thereafter, as shown in FIG. 4, the strips 32 can be removed from the strap 12 by simply peeling them off of the strap 12 as shown at 40 and thereafter replaced with a fresh strip 32 of double-sided adhesive tape. In practice, it has been found that it is necessary to replace the double-sided adhesive strips 32 with fresh strips after the strips 32 become dirty from the panel 20.

From the foregoing, it can be seen that the present invention provides a simple and yet totally effective tool particularly suited for bending body panels in automotive body working. Having described our invention, however, many modifications thereto will become apparent to those skilled in the art to which it pertains without deviation from the spirit of the invention as defined by the scope of the appended claims.

We claim:

1. A device for use in repairing automotive bodies comprising:

an elongated flexible strap having a flat and elongated side, a ring, means for attaching said ring to an end of said strap, at least one elongated flat strip, said strip having an adhesive layer on both sides of the strip, wherein one side of said strip is adhesively secured to the elongated flat side of said strap, wherein the other side of said strip is removably adhesively secured to the automotive body so that a longitudinal force imposed on said strap through said ring is transmitted through said strip to the automotive body.

2. The invention as defined in claim 1 wherein said strap is constructed of neoprene rubber.

3. The invention as defined in claim 2 wherein said strap is reinforced with nylon fibers.

4. The invention as defined in claim 1 wherein said ring comprises a straight ring segment and a tube coaxially rotatably mounted around said ring segment.

5. The invention as defined in claim 4 wherein said attaching means comprises a section of fabric, means for attaching the fabric section to said end of said strap so that said fabric section forms a loop, said tube being disposed in said loop.

6. The invention as defined in claim 1 and comprises a plurality of elongated flat strips, each strip having an adhesive layer on both sides, said strips being adhesively secured to said strap so that said strips are spaced apart and parallel to each other.

* * * * *